US006385832B1

(12) United States Patent
Grafe et al.

(10) Patent No.: US 6,385,832 B1
(45) Date of Patent: May 14, 2002

(54) DESCALING DEVICE FOR A CONTINUOUS CAST METAL STRIP

(75) Inventors: Horst Grafe; Barbara Ladda-Zunk; Karl-Friedrich Fuhrmann, all of Hilchenbach (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 54 days.

(21) Appl. No.: 09/637,554

(22) Filed: Aug. 11, 2000

(30) Foreign Application Priority Data

Aug. 14, 1999 (DE) ..... 199 38 705

(51) Int. Cl.[7] ..... B21B 45/04; B21C 43/00; B23K 7/00; B08B 3/00

(52) U.S. Cl. ..... 29/81.08; 29/81.01; 29/81.05; 29/81.06; 29/81.13; 134/56 R; 134/198

(58) Field of Search ..... 29/81.08, 81.01, 29/81.05, 81.06, 81.13; 134/56 R, 122 R, 198; 239/263, 264

(56) References Cited

U.S. PATENT DOCUMENTS 5,502,881 A * 4/1996 Gaydoul ..... 29/81.08
5,505,786 A * 4/1996 Cole et al. ..... 134/2
6,029,681 A * 2/2000 Gaydoul et al. ..... 134/56 R

FOREIGN PATENT DOCUMENTS

DE 3200235 * 1/1983
DE 2922701 11/1983
DE 4328303 6/1994
DE 198 17 002.5 4/1998
EP 0360480 11/1994
WO 9711797 4/1997

* cited by examiner

*Primary Examiner*—S. Thomas Hughes
*Assistant Examiner*—John C. Hong
(74) *Attorney, Agent, or Firm*—Friedrich Kueffner

(57) ABSTRACT

A descaling device for hydromechanically descaling metal strip has a descaling spray arrangement with first and second spray nozzles arranged adjacent to one another in first and second spray nozzle rows transverse to the transport direction with several first and second spray nozzle rows successively arranged in the transport direction above a top side and underneath a bottom side of the metal strip. The first and second spray nozzles spray a high pressure water jet onto the top and bottom sides. First catch troughs are correlated with the first spray nozzles and catch water of the high pressure water jets of the first spray nozzles. The first spray nozzle rows together with the first catch troughs are pivotable about a pivot axis and vertically adjustable relative to the top side by a signal from a measuring device. The first catch troughs are pivotable independently Of the first water spray nozzles counter to the transport direction about a pivot point and vertically adjustable and automatically yielding relative to the top side. The first spray nozzle rows are arranged in first spray beams, wherein each spray beams has a lever and is freely pivotable about the pivot point of the first catch troughs in order to be vertically adjustable and automatically yielding relative to the top side.

14 Claims, 2 Drawing Sheets

DESCALING DEVICE FOR A CONTINUOUS CAST METAL STRIP

BACKGROUND OF THE INVENTION

1. Field of the Invention

The invention relates to a device for hydromechanical descaling of continuous cast slab and/or hot-rolled metal strip, especially of steel, comprising water spray nozzles, correlated respectively with one strip side and arranged successively in the transport direction of the strip as well as laterally adjacently to one another, for spraying high-pressure water jets onto the two strip surfaces, wherein the rows of spray nozzles arranged on the top side of the strip together with catch troughs are arranged to be pivotable about an axis, respectively, and are vertically adjustable relative to the top side of the strip according to a signal of a measuring device.

2. Description of the Related Art

When hot-rolling slab and strips, the scale must be removed before rolling in order to achieve a good quality surface. It is known to perform such descaling by high-pressure water ejected from nozzle devices with pressures of up to 1,000 bar. It is known to arrange stationary upper and lower nozzles with relatively large spacing to the strip surface so that strip thickness variations and wave-shaped strip irregularities can be compensated. A disadvantage is that on the "wave peak" the descaling parameters (impact, spacing, coverage etc.) are optimal, but are unsatisfactory on the "flat" strip.

A known descaling device for descaling with high pressure water is disclosed in patent document DE 43 28 303 A1. In the nozzle device known from this patent document a row of rotating nozzle heads, having respectively four nozzles distributed about the circumference for spraying high-pressure water, is mounted on a beam, which is stationarily arranged transverse to the movement direction of the rolling stock moved underneath it at such a spacing that the curved portions and irregularities of the rolling stock guided along the spray device will not cause a collision. Accordingly, this spacing is comparatively large. This reduces the jet pressure of the high-pressure water on the rolling stock, and this can only be compensated by increasing the water pressure or the amount of water thus requiring a great energy expenditure.

In order to avoid these disadvantages, a device for descaling of semi-finished products has been proposed with the German patent application P 198 17 002.5, which was not published at the time of filing the priority application of the instant application. This device applies a fluid at high pressure onto the surface of the semi-finished product being moved relative to the spray device and comprises also, if needed, a device for removing the scale. With this device a more uniform descaling impact pressure, the so-called impact, and thus a more uniform descaling across the strip width and length can be achieved in comparison to conventional devices. For this purpose, means are provided for a direct detection of the strip profile, wherein, as a function thereof, the spray device and/or the scale removal device can be individually vertically adjusted, respectively.

The patent document EP 0 360 480 B1 describes a descaling device for a material strip with a device for bending the strip at one point by means of at least one bending roll and a water spraying device which sprays the water onto a descaling location which is spaced slightly from-the bending location in the strip transport direction. By bending the strip, the scale is supposed to break off, respectively, become detached from the surface of the strip so that the descaling action can be performed at a comparatively reduced water pressure.

The document WO 97/11797 describes a device for descaling semi-finished products. In this arrangement, a nozzle device with a vertical component is arranged above the surface of the semi-finished product and is moveable by means of a drive. A travel transducer for detecting the spacing of the nozzle arrangement from the surface is provided. Moreover, a control device for acting on the drive as a function of an output signal of the travel transducer is provided for maintaining the spacing at a constant value.

The patent document DE 29 22 701 C2 discloses a device for descaling hot-rolled metal strip in a strip mill train in which the strip, after descaling, is cold-rolled in a downstream rolling stand. Nozzle rows for spraying descaling agent are provided which are correlated with one strip side and arranged successively in the transport direction of the strip but staggered relative to one another. Each of the nozzle rows parallel to the plane of the strip is pivotable by means of a holder about an axis, that is perpendicular to the strip plane and to the longitudinal center axis of the strip, by an adjustable angle $\alpha$ relative to the longitudinal center axis of the strip and is secured at a slant angle, the so-called jet impact angle $\beta$, of the nozzle axes to the strip surface of less than 90°. The holder of a nozzle bearing block supporting the nozzle row has a pivot device for changing the slant angle, respectively, the jet impact angle $\beta$ of the nozzle axes to the strip surface while at the same time maintaining the point of the interception of the nozzle axes with the strip plane.

SUMMARY OF THE INVENTION

It is an object of the present invention to provide a device for hydromechanical descaling of the aforementioned kind, which, in comparison to the prior art, is developed to an extremely efficient functional unit and which has significant advantages in the case of a collision.

In accordance with the present invention, this is achieved in that the water catch troughs are pivotable about a pivot point counter to the transport direction of the strip and independent of the water spray nozzles and are vertically adjustable relative to the metal strip and automatically yielding, and in that the spray beams receiving the spray nozzle rows at the top side of the metal strip are freely pivotable by means of a lever arm about the pivot point of the water catch troughs and are thus, within limits, vertically adjustable as well as automatically yielding. With these measures, the collision risk with the metal strip is significantly reduced.

According to one embodiment of the invention, it is proposed that the spray nozzle rows, together with the spray beams receiving them as well as the catch troughs interacting therewith, at the top side of the metal strip are positioned within a hood receiving the spray nozzle rows and the spray beams with their pivot axes, wherein the hood is supported by four lifting cylinders arranged on the corners of the hood and correlated with the upper drive rolls.

With the inventive configuration of the descaling device an extremely compact design is realized wherein the hood receiving the spray beams and the catch troughs can be immediately lifted, for example, in the case of an upwardly bent leading strip portion, with the aid of the four lifting cylinders arranged on the corners, and repair work and/or servicing or maintenance is facilitated.

DESCRIPTION OF THE PREFERRED EMBODIMENTS

Figure 1:
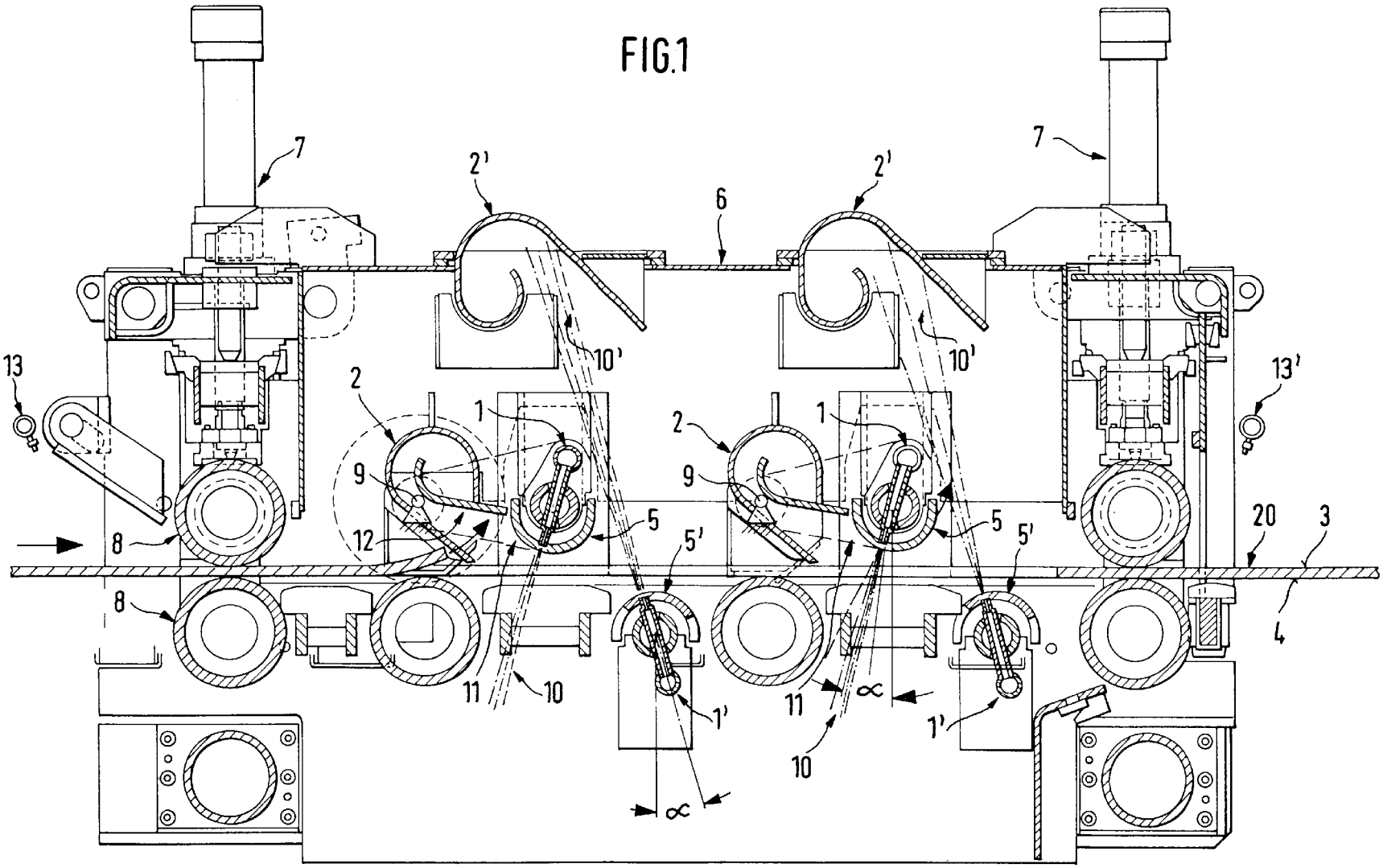
FIG. 1 is a side view in longitudinal section of a descaling spray arrangement of a descaling device according to the invention.
Figure 2:
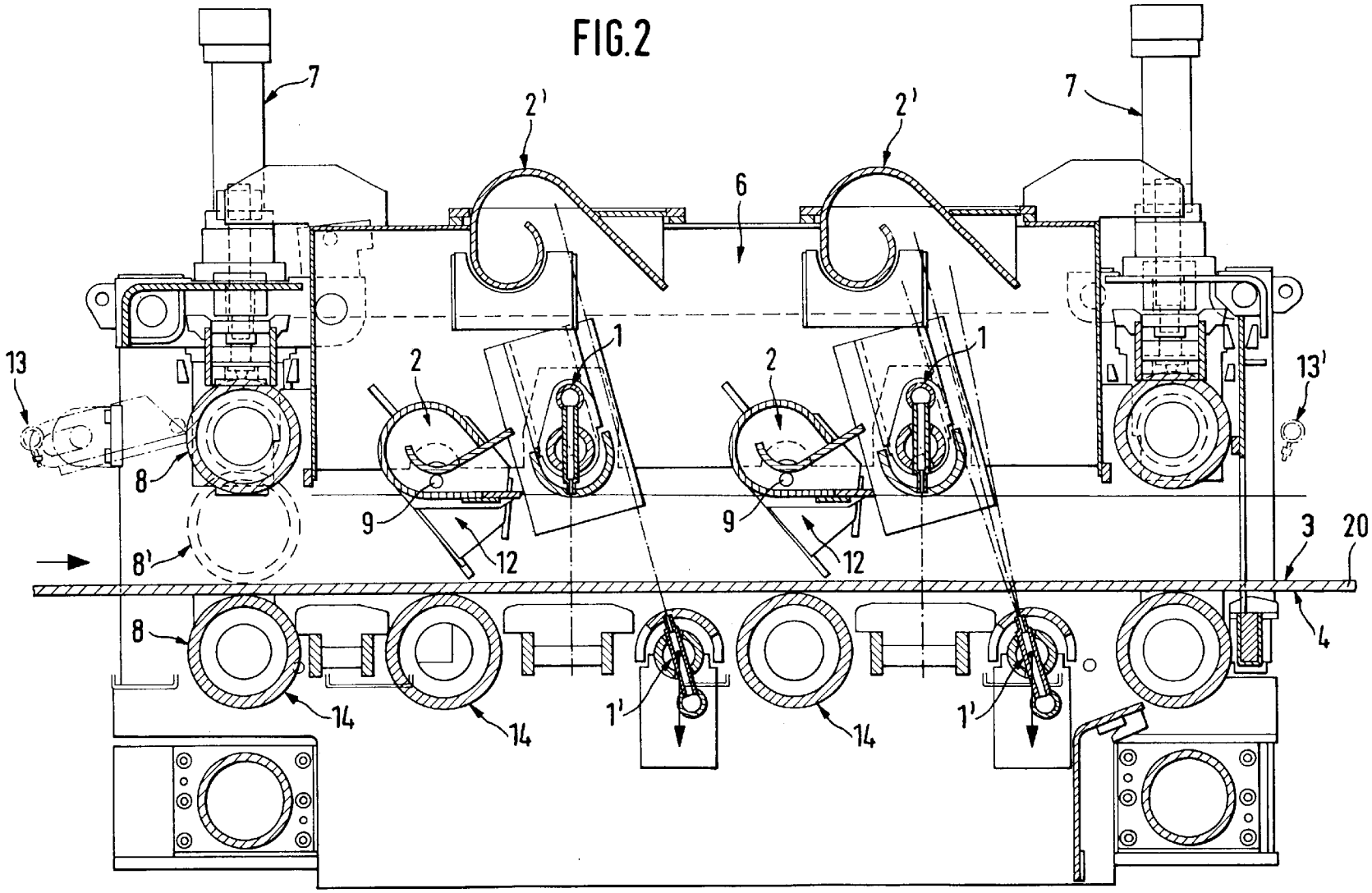
FIG. 2 is a side view in longitudinal section of the descaling spray arrangement of the descaling device according to FIG. 1 with the detachable top being in the lifted position.

The device for hydromechanical descaling of continuous cast slab and/or hot-rolled metal strip 20, especially of steel, as shown in FIGS. 1 and 2, comprises water spray nozzles 1, 1', respectively correlated with one of the strip sides 3, 4 and arranged successively in the transport direction of the metal strip as well as laterally staggered in rows relative to one another, for spraying high-pressure water jets 10, 10' with approximately 600 bar onto the two sides of the strip. The spray nozzle rows 1 correlated with the top side 3 of the strip are pivotable together with the catch troughs 2 about a pivot axis, respectively, which pivot axis is parallel to the surface of the strip and perpendicular to the longitudinal center plane of the strip, and are height adjustable (vertically adjustable) according to a signal of a measuring device (not shown) relative to the top side 3 of the strip. At the top side 3 of the strip, the nozzle rows 1 are arranged, together with the spray beams 5 receiving them as well as with the catch troughs 2 cooperating therewith, in a hood 6 receiving them together with their pivot axles. The hood 6 is supported by four lifting cylinders 7 arranged on the corners of the hood 6 and correlated with the upper drive rolls 8, respectively. The interior of the hood 6 is comparatively generously dimensioned with regard to height, width, and length in order to prevent disturbance edges and turbulence zones for the water and the scale.

The hood 6 can be decoupled from the drive rolls 8 by means of a detachable connection. For example, FIG. 2 shows the hood 6 in the lifted position, wherein, after decoupling of the drive roll 8 from the advancing cylinder 7 on the left-hand side, the drive roll 8', shown in dashed-lines, of still cooperates with the counter roll below the strip 20 so that the strip can still be pulled.

FIGS. 1 and 2 also show that in the upper area of the hood 6, laterally relative to the strip 20, catch troughs 2' for water and scale, coming from the spray nozzles 1' correlated with the bottom side 4 of the strip, are provided.

The configuration of the spray nozzle arrangement of the descaling device according to the invention is such that the top with the hood 6, lifting cylinders 7, drive rolls 8, and pipe connections can be lifted, preferably by means of a crane, for the purpose of repair work and/or maintenance work.

Furthermore, it is suggested that spray pipes 13 for low-pressure water of, for example, 10 bar, are arranged at a comparatively tight spacing upstream of the descaling spray arrangement for the purpose of breaking off the scale by means of spontaneous temperature quenching. Very beneficial may also be the arrangement of at least one spray pipe 13' downstream of the descaling spray nozzle arrangement for the purpose of a final cleaning of the strip 20 from detached scales.

The spray beam 5' correlated with the bottom side 4 of the strip can be lowered independently of the spray beams 5 correlated with the top side 3 of the strip. In this context, the strip 20 is transported, as is conventional, on drivable transport rolls of a roller table 14.

The water catch troughs 2 are pivotable about a pivot point 9 counter to the transport direction of the strip independently of the water spray nozzles 1 and are automatically vertically adjustable (height adjustable) with their catch opening or mouth 12 relative to the strip 20. This has the advantage that in an undisturbed operational state the catch opening 12 of the catch troughs 2 glides along the surface 3 of the strip 20 while resting loosely thereon, that, however, in the presence of, for example, an upwardly bend strip end (FIG. 1, left side) the catch troughs 2 are automatically lifted off the surface of the strip by pivoting about the pivot point 9. This advantageously prevents collisions within the descaling spray arrangement of the descaling device.

Furthermore, it is provided that the spray beams 5 at the top side 3 of the strip, as can be seen in FIG. 1, are freely pivotable by means of a lever arm 11 about the pivot point 9 of the water catch troughs 2 and are thus, within limits, vertically adjustable (height adjustable) as well as automatically yielding when an obstacle occurs. Moreover, the spray nozzles 1, 1' are angularly adjustable and preferably adjusted relative to the strip with an acute angle a counter to the strip transport direction.

One embodiment of the invention provides, as shown in FIG. 2, that the hood 6 together with the spray beams 5 and the catch troughs 2 can be lifted comparatively high off the strip 20 by means of the lifting cylinders 7 for releasing a free passage.

As illustrated in FIGS. 1 and 2, the configuration according to the invention provides a device for hydromechanical descaling of continuous cast slab and/or hot-rolled,metal strip in the form an extremely compact functional unit with significantly reduced malfunction liability.

While specific embodiments of the invention have been shown and described in detail to illustrate the inventive principles, it will be understood that the invention may be embodied otherwise without departing from such principles.

What is claimed is:

1. A descaling device for hydromechanically descaling continuous cast slab and/or hot-rolled metal strip moving through the descaling device in a transport direction, the descaling device having a descaling spray arrangement comprising first spray nozzles arranged adjacent to one another in first spray nozzle rows transverse to the transport direction, with several first spray nozzle rows successively arranged in the transport direction above a top side of the continuous cast slab and/or hot-rolled metal strip, and second spray nozzles arranged adjacent to one another in second spray nozzle rows transverse to the transport direction, with several second spray nozzle rows successively arranged in the transport direction underneath a bottom side of the continuous cast slab and/or hot-rolled metal strip, wherein the first and second spray nozzles are configured to spray a high pressure water jet onto the top and bottom sides, the descaling spray arrangement further comprising first catch troughs correlated with the first spray nozzles and configured to catch water of the high pressure water jets of the first spray nozzles, wherein the first spray nozzle rows together with the correlated first catch troughs are configured to pivot about a respective pivot axis and to be vertically adjustable relative to the top side by a signal transmitted from a measuring device, wherein the first catch troughs are configured to pivot independently of the first spray nozzles counter to the transport direction about a pivot point and to be vertically adjustable and automatically yielding relative to the top side, and wherein the descaling device comprises first spray beams in which the first spray nozzle rows are arranged, wherein each one of the spray beams comprises a lever, and wherein the spray beams are configured to pivot freely about the pivot point of the first catch troughs in order to be vertically adjustable and automatically yielding relative to the top side.

2. The descaling device according to claim 1, further comprising second spray beams in which the second spray nozzle rows are arranged, wherein the second spray beams are configured to be lowered independently of the first spray nozzle rows.

3. The descaling device according to claim 1, wherein the first and second spray nozzles are configured to be angularly adjustable to direct the high pressure water jets at a selectable angle against the top and bottom sides in a direction counter to the transport direction.

4. The descaling device according to claim 3, wherein the selectable angle is an acute angle.

5. The descaling device according to claim 1, further comprising a hood with four lifting cylinders mounted on corners of the hood, wherein the lifting cylinders are configured to cooperate with upper drive rolls of a transport device of the descaling device, wherein the first spray nozzle rows and the first spray beams and the correlated first catch troughs are arranged in the hood.

6. The descaling device according to claim 5, wherein the hood has an interior having a height, a length, and a width configured to prevent disturbance edges and turbulence zones for the water of the water jets and for the scale removed from the continuous cast slab and/or hot-rolled metal strip.

7. The descaling device according to claim 5, wherein the hood and the drive rolls are connected by a detachable connection configured to decouple the hood and the drive rolls from one another.

8. The descaling device according to claim 5, comprising second catch troughs correlated with the second spray nozzles and positioned within the hood adjacent to the continuous cast slab and/or hot-rolled metal strip for catching the water of the second water jets of the second spray nozzles and scale removed from the continuous cast slab and/or hot-rolled metal strip.

9. The descaling device according to claim 5, wherein the hood with the lifting cylinders, the drive rolls and pipe connections for the spray nozzles together form a detachable top of the descaling device configured to be lifted off for repair work or maintenance work.

10. The descaling device according to claim 9, wherein detachable top is configured to be lifted by a crane.

11. The descaling device according to claim 5, wherein the hood together with the first spray beams and the catch troughs is configured to be lifted off the continuous cast slab and/or hot-rolled metal strip by the lifting cylinders in order to provide a free passage.

12. The descaling device according to claim 1, comprising spray pipes arranged upstream of the descaling spray arrangement in the transport direction, wherein the spray pipes are configured to spray low pressure water.

13. The descaling device according to claim 12, wherein the low pressure water is sprayed at 10 bar.

14. The descaling device according to claim 1, comprising at least one spray pipe arranged downstream of the descaling spray arrangement in the transport direction.

* * * * *